US006514013B2

(12) United States Patent
Li et al.

(10) Patent No.: US 6,514,013 B2
(45) Date of Patent: Feb. 4, 2003

(54) ANCHOR ROD WITH SURFACE AREAS AND FRICTION

(75) Inventors: Longfei Li, Kaiserslauten (DE); Hans Warnke, Mackenbach (DE)

(73) Assignee: MKT Metall-Kunststoff-Technik GmbH & Co. KG, Weilerbach (DE)

( * ) Notice: Subject to any disclaimer, the term of this patent is extended or adjusted under 35 U.S.C. 154(b) by 0 days.

(21) Appl. No.: 09/725,922

(22) Filed: Nov. 30, 2000

(65) Prior Publication Data

US 2002/0064430 A1 May 30, 2002

(51) Int. Cl.[7] ..... E21D 21/00

(52) U.S. Cl. ..... 405/259.5; 405/259.1; 411/82

(58) Field of Search ..... 405/259.5, 259.1, 405/259.2, 259.3, 259.4, 259.6; 411/82, 82.1–82.3, 385, 914; 52/698

(56) References Cited

U.S. PATENT DOCUMENTS 4,983,083 A * 1/1991 Froehlich et al. ..... 411/82
5,263,804 A * 11/1993 Ernst et al. ..... 411/82
5,735,653 A * 4/1998 Schiefer et al. ..... 411/82
6,240,696 B1 * 6/2001 Ludwig et al. ..... 405/259.5

FOREIGN PATENT DOCUMENTS

| | | | |
|---|---|---|---|
| DE | 24 50 473 | A | 5/1976 |
| DE | 27 55 831 | C2 | 7/1985 |
| DE | 38 23 163 | A1 | 2/1990 |
| DE | 37 08 764 | C2 | 7/1995 |
| EP | 0 167 484 | A1 | 1/1986 |
| EP | 04 26 951 | A2 | 5/1991 |
| GB | 1 340 117 | A | 12/1973 |
| WO | WO88 07141 | A | 9/1988 |

* cited by examiner

*Primary Examiner*—Frederick Lagman
(74) *Attorney, Agent, or Firm*—Browdy and Neimark

(57) ABSTRACT

In an anchor rod (1) for a synthetic resin adhesive anchor having a shaft (2) with a plurality of area segments (4) arranged in axial succession, the surface of which is low-friction with respect to synthetic resin mortar (6), areas (4) are formed. Viewed in a circumferential direction, the areas are arranged side by side such that a desired splitting zone (9) is created in the transition region of two adjacent areas (4) of this type.

9 Claims, 5 Drawing Sheets

Figure 1:
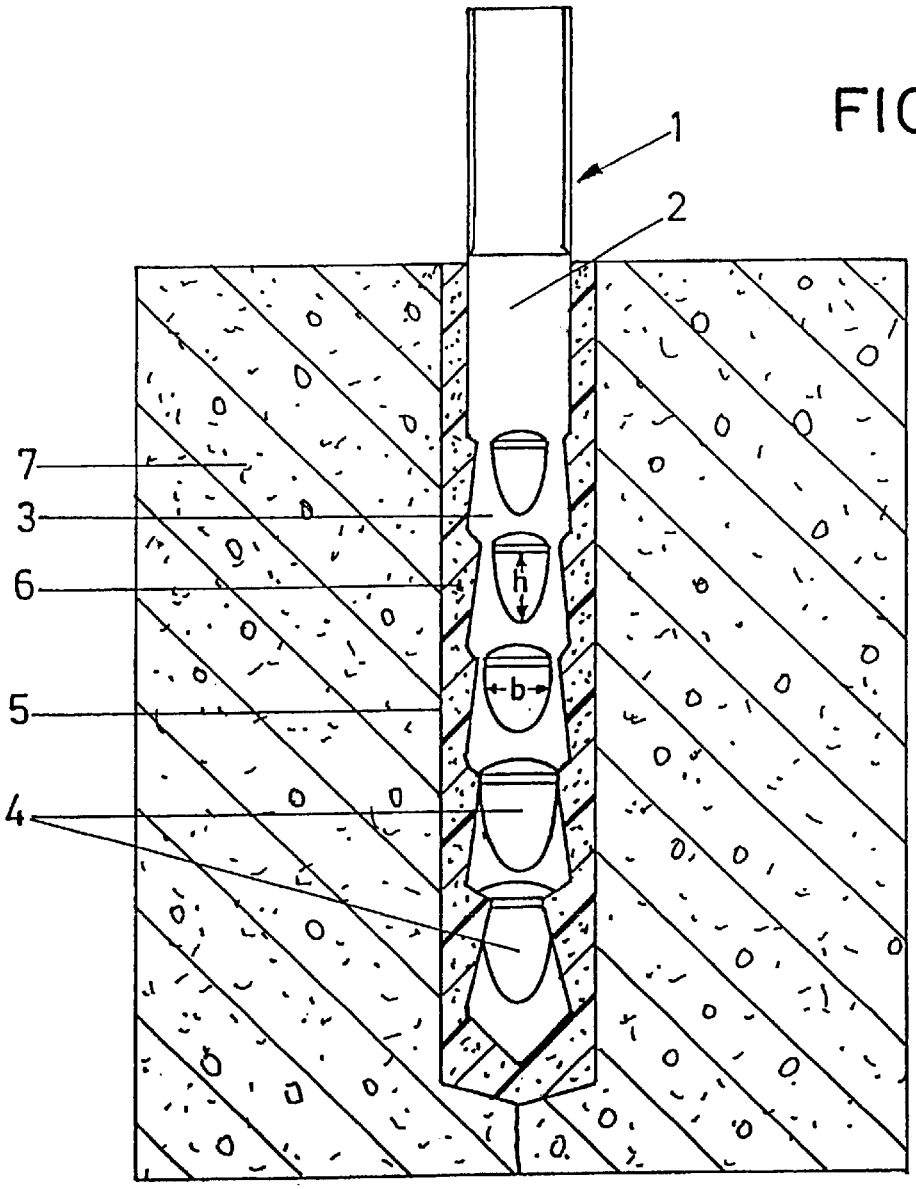

FIG. 3
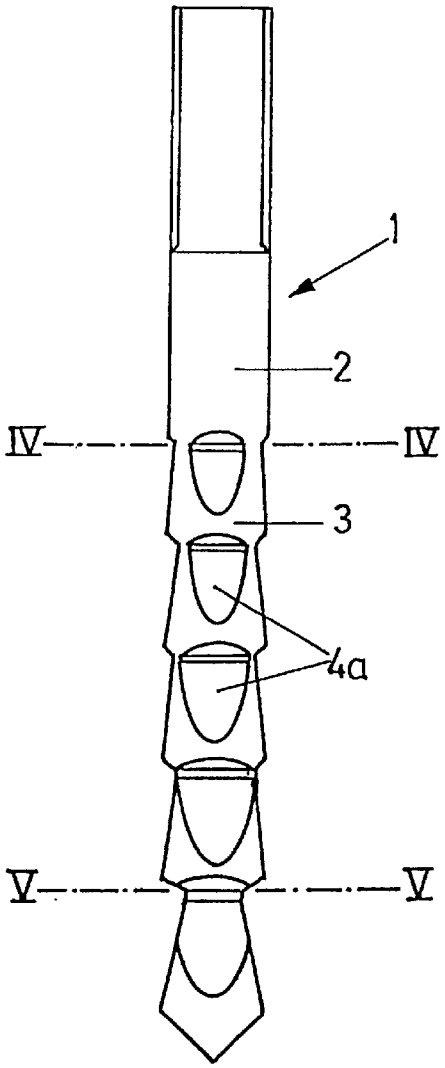
FIG. 6
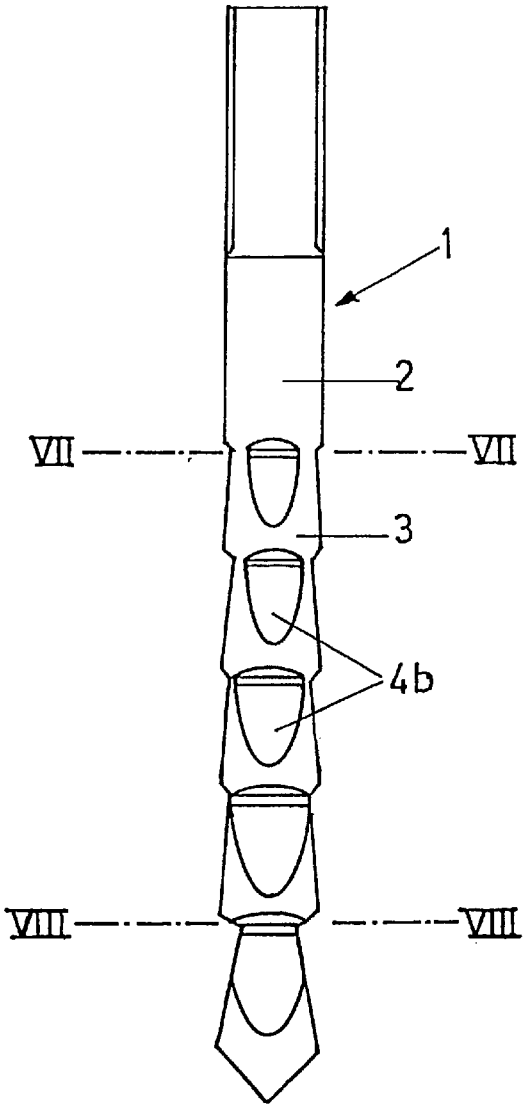
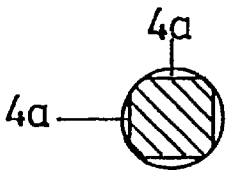
FIG. 4
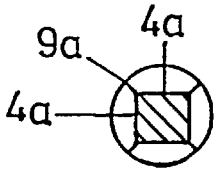
FIG. 5
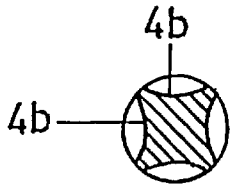
FIG. 7
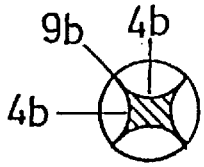
FIG. 8

FIG. 9
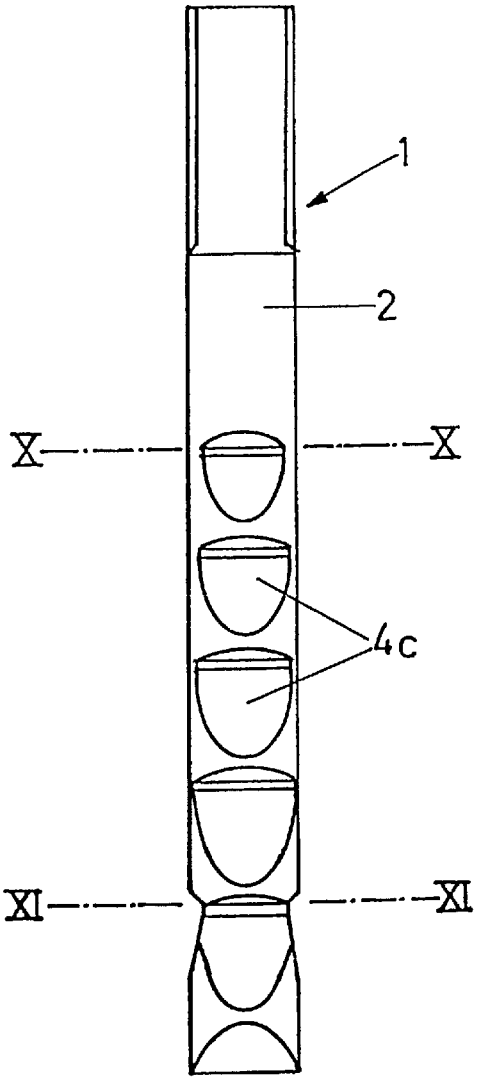
FIG. 12
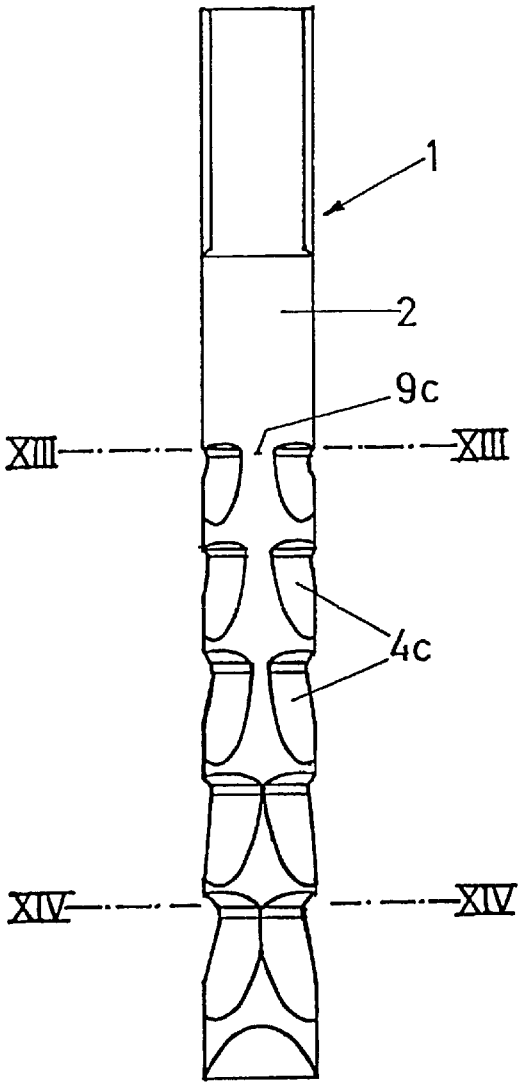
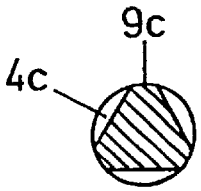
FIG.10
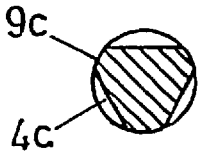
FIG.13
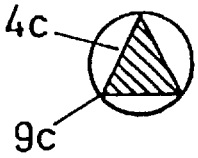
FIG.11
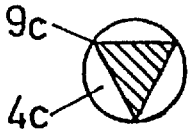
FIG.14

FIG.15
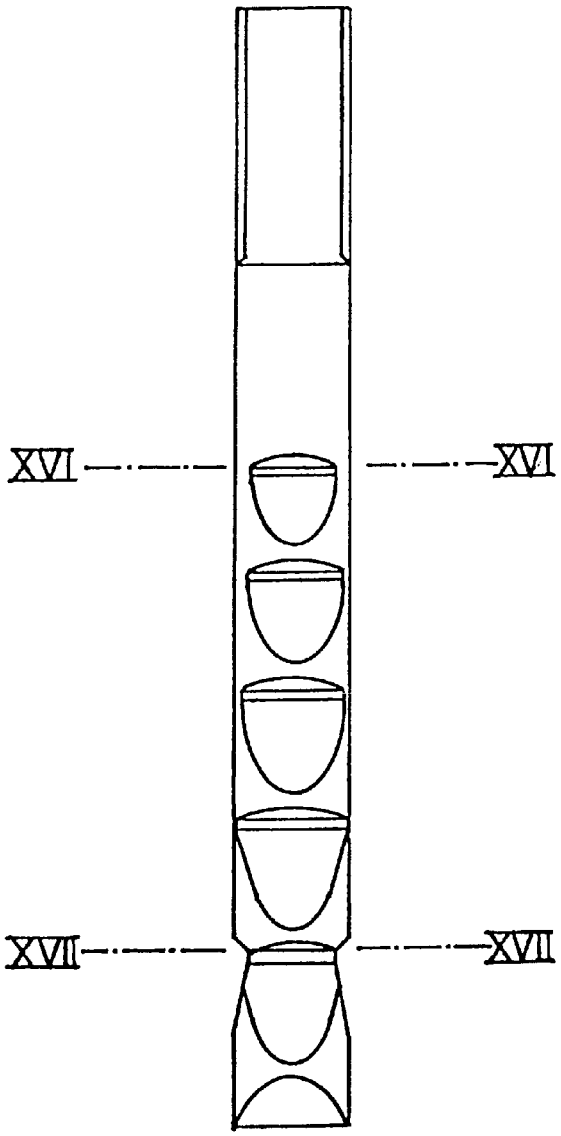
FIG.18
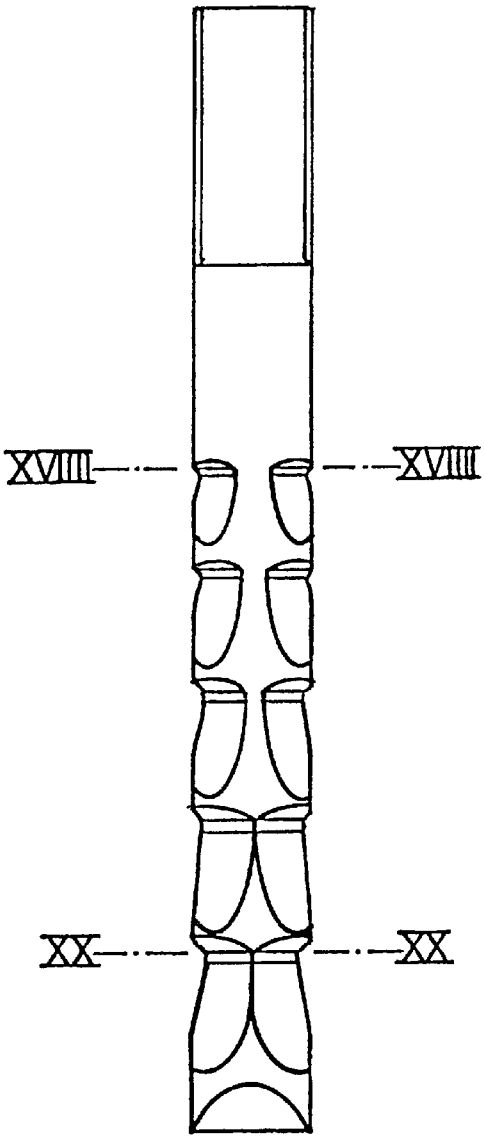
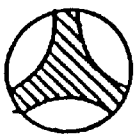
FIG.16
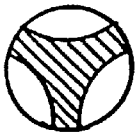
FIG.19
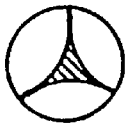
FIG.17
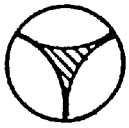
FIG.20

FIG. 21
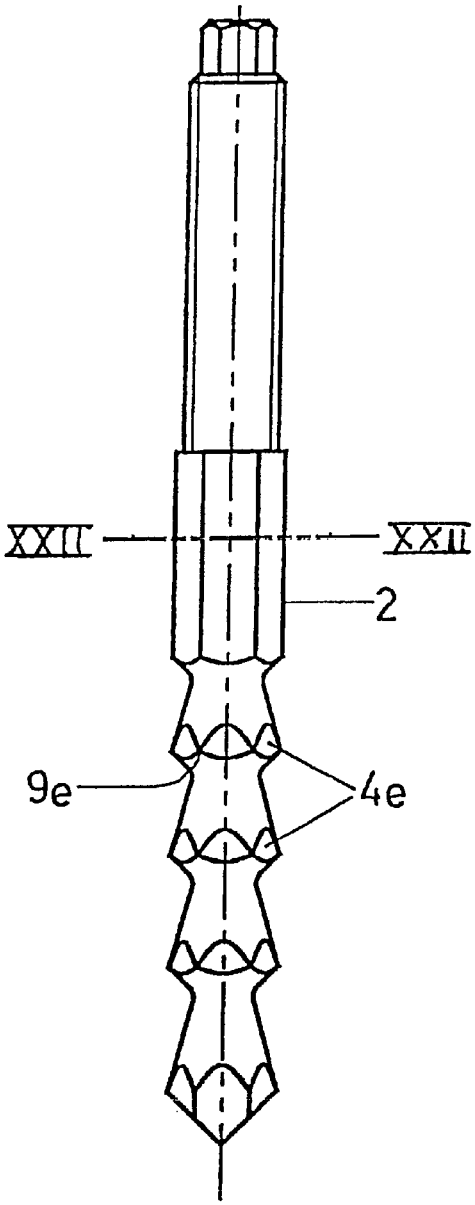
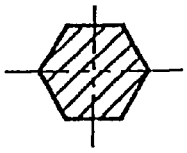
FIG. 22
FIG. 23
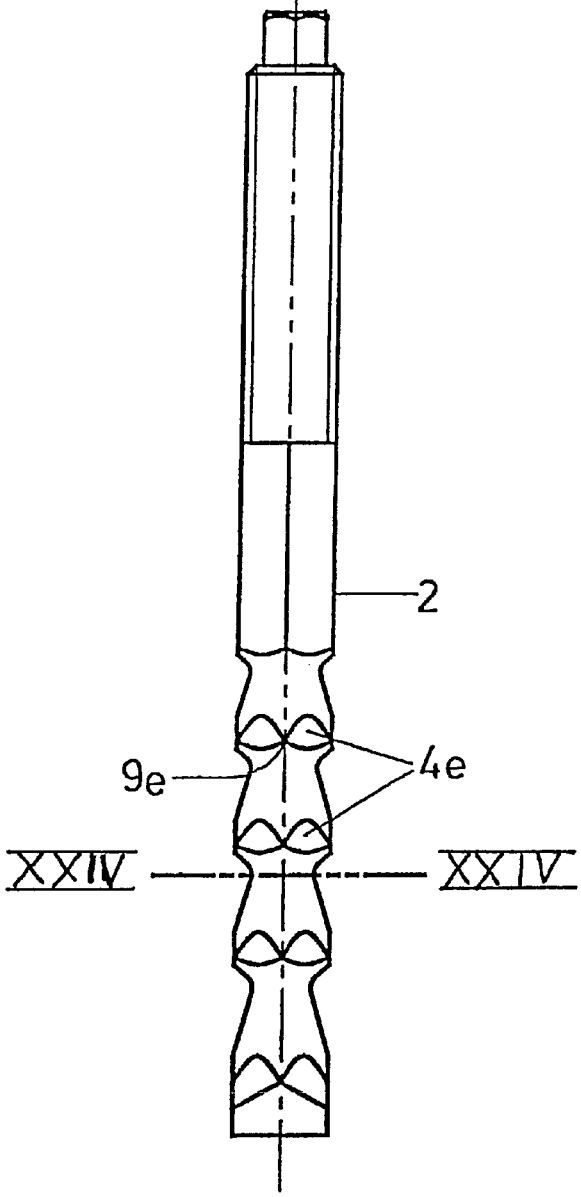
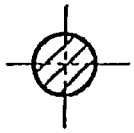
FIG. 24

ANCHOR ROD WITH SURFACE AREAS AND FRICTION

FIELD OF THE INVENTION

The present invention relates to an anchor rod for a synthetic resin adhesive anchor having a shaft, which has a plurality of areas arranged in axial succession, the surfaces of which are low-friction with respect to synthetic resin mortar.

REVIEW OF THE RELATED TECHNOLOGY

One anchor rod of this type is known, for example, from EP 0 356 425 B 1. Anchor rods of the type in question have the advantage that during hardening of the synthetic resin mortar a shell of mortar is formed, relative to which the anchor rod can be shifted in an axial direction when the mortar shell cracks or when the interior diameter of the mortar shell changes when a dynamic fracture occurs. The axial movement of the anchor rod then results in the build-up of a corresponding expansion pressure.

The known products have the shortcoming, however, that a protective grating must be provided for practical implementation, to prevent damage to the coating on the cone areas during insertion of the anchor rod into the borehole.

From DE 38 23 863 A1 an anchor rod is known with areas in the region of the cone that are formed at an angle to the longitudinal axis. However, this anchor rod is not suitable for creating a desired splitting zone in the region of the shaft.

From DE 196 34 912 A1 an anchor rod comprising a shaft with a spiral configuration is known, by which a splitting of the borehole can also not be attained, and the use of which creates problems if the anchor mortar contains coarse aggregates.

OBJECTS AND SUMMARY OF THE INVENTION

Based on the above, it is the aim of the present invention to improve an anchor rod of the above type in such a way that it becomes possible to insert the anchor rod into the borehole without additional protective measures while maintaining the advantage of attaining high pull-out forces even when cracks develop in the concrete.

This aim is met with areas that are formed and, viewed in a circumferential direction, arranged such that a desired splitting zone is created in the transition region of two adjacent areas of this type, with a friction-increasing coating provided.

The cross-section of the shaft in the region of the areas is preferably such that the areas approximately correspond to a triangle or square inscribed in the cylindrical envelope curve or in the borehole diameter.

In a further embodiment of the invention the sides of the triangle or square may be shaped concave toward the longitudinal center axis.

Cone sections may advantageously be formed on the shaft in such a way that each of the areas is formed on a cone section of the shaft, superimposed on the same.

It has proven particularly advantageous that the axial and/or radial size of the areas increases toward the front end, relative to the insertion direction.

To sum up the advantages of the inventive solution, it can be said that it obviates the requirement for additional form ribs or steel grates so that the borehole does not need to be created enlarged, and mortar and expended energy can be saved during the creation of the borehole, as well as working time. Also, during the manufacture of the anchor rod as such, steps such as for attaching a grate can be saved, thus resulting in a cost savings.

The geometry of the present invention permits cleaning of the borehole, and damage to the surfaces or to the coating provided on same of the function-relevant surfaces is prevented during placement of the anchor rod.

The wall strength of the cured mortar shell varies due to the areas. An anchor rod designed according to the invention with a plurality of areas that adjoin in a circumferential direction, therefore, has the characteristic quality that the cured mortar shell is split in precisely defined locations, which results in superior post-expansion properties of the system.

Particularly advantageous is a friction-increasing coating provided on the shaft in the form of a shrinkdown plastic tubing. In combination with a preferably hexagonal shaft cross-section, this achieves that the coating of shrinkdown plastic tubing cannot twist relative to the shaft, that a very good blending of the mortar can be attained when it is entered by means of a percussion drill, and also a very good disintegration of the filler material.

BRIEF DESCRIPTION OF THE DRAWING FIGURES

Figure 2:
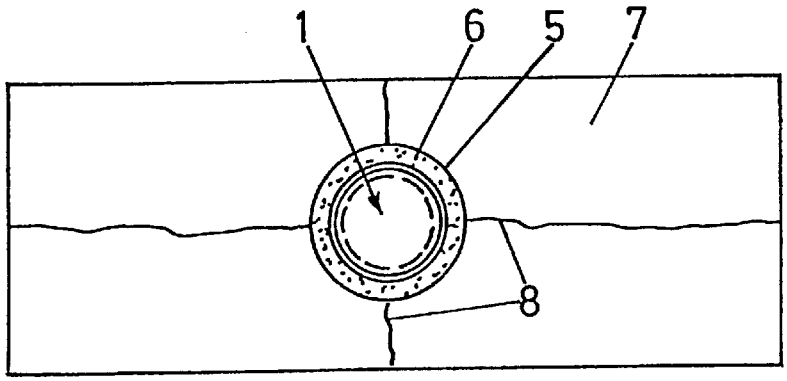

The invention is explained in detail below based on preferred embodiments, in connection with the drawings in which:

FIG. 1 is a longitudinal section view through a first embodiment of an anchor rod that is inserted in a borehole, FIG. 2 is a plan view of the illustration according to FIG. 1, FIG. 3 is a view corresponding to FIG. 1 but with the anchor rod not inserted in the borehole, FIG. 4 is a section along the line IV—IV in FIG. 3, FIG. 5 is a section along the line V—V in FIG. 3, FIG. 6 is a view, corresponding to FIG. 3, of an embodiment with a modified cross-section, FIG. 7 is a section along the line VII—VII in FIG. 6, FIG. 8 is a section along the line VIII—VIII in FIG. 6, FIG. 9 is a view corresponding to FIG. 3 of a further embodiment, FIG. 10 is a section along the line X—X in FIG. 9, FIG. 11 is a section along the line XI—XI in FIG. 9, FIGS. 12 through 14 correspond to FIGS. 9–11 at a rotation of 90°, FIG. 15 is a view corresponding to FIG. 3 of a further embodiment, FIG. 16 is a section along the line XVI—XVI in FIG. 15, FIG. 17 is a section along the line XVII—XVII in FIG. 15, FIGS. 18 to 20 correspond to FIGS. 15 to 17 at a rotation of 90°, FIG. 21 is a view of an embodiment with a hexagonal shaft, FIG. 22 is a section along the line XXII—XXII in FIG. 21, FIG. 23 is a view rotated relative to FIG. 21, and FIG. 24 is a section along the line XXIII—XXIII in FIG. 23.

DETAILED DESCRIPTION OF THE PREFERRED EMBODIMENTS

In FIG. 1 the anchor rod 1 of the present invention is depicted, which has a substantially cylindrical shaft 2, at the lower end of which a plurality of segments are formed on which areas 4 are formed that are recessed relative to the cylindrical outer face 3, and the width b and height h of which increases toward the insertion end.

In FIG. 1 the anchor rod 1 is depicted inserted in a borehole 5, which is filled with synthetic resin mortar 6. The borehole 5 is drilled into a concrete structure 7, in which, as indicated in FIG. 2, cracks 8 may occur.

Various cross-section geometries are possible for the implementation of the invention, which are explained below based on the following figures:

In the embodiment according to FIGS. 3 through 5, the cross-sections in the region of the respective recessed areas 4 and the recessed areas 4*a* that adjoin in a circumferential direction are square, as can be seen from FIGS. 4 and 5, with the areas as such formed flat. In the transition region of two areas 4*a* of this type a desired splitting zone 9*a* is formed.

In the embodiment according to FIGS. 6 to 8 the cross-sections are approximately square, however, with the recessed areas 4*b* formed concave.

In the embodiments depicted in FIGS. 9 through 14 the configuration of the cross-section is triangular with the recessed areas 4*c* as such again formed flat. In these embodiments three desired splitting zones 9*c* are formed in the transition region of these areas. In the embodiment depicted in FIGS. 15 to 20 the configuration of the cross-section is nearly triangular, with the recessed areas 4*d* formed concave and forming three desired splitting zones 9*d*.

In the embodiment depicted in FIGS. 21 to 24 the shaft has a hexagonal cross-section. The areas 4*e* are immediately adjoining so that the splitting zones 9*e* essentially form a ridge that extends in an axial direction.

What is claimed is:

1. An anchor rod for use with a synthetic resin mortar (6), the anchor rod including a shaft (2) having a length and a surface;

the surface of the shaft (2) comprising sets of areas (4) arranged side by side in a circumferential direction and formed such that transition regions between circumferentially adjacent areas (4) comprises a splitting zone (9);

the sets being disposed along the length of the shaft; and the surface of the shaft comprising a friction-increasing coating;

wherein the areas are formed on a prismatic polygonal envelope portion of the surface of the shaft.

2. The anchor rod according to claim 1, wherein a cross section of the prismatic polygonal envelope portion is hexagonal.

3. The anchor rod according to claim 1, wherein a cross section of the prismatic polygonal envelope portion is square.

4. The anchor rod according to claim 1, wherein the areas are located in the extension of the planes of the prismatic polygonal envelope portion of the shaft.

5. The anchor rod according to claim 1, comprising approximately conical recesses between axially successive sets of areas.

6. The anchor rod according to claim 1, wherein the areas are located in the extension of the planes of the prismatic polygonal envelope portion of the shaft.

7. The anchor rod according to claim 1, comprising plural sets of the plurality of areas (4), the sets being disposed along a length of the shaft and increasing in size toward an insertion end of the shaft.

8. The anchor rod according to claim 7, wherein the size is measured in an axial direction by a height (h).

9. The anchor rod according to claim 7, wherein the size is measured in a radial direction by a width (b).

* * * * *